US006222527B1

(12) United States Patent
Hu

(10) Patent No.: US 6,222,527 B1
(45) Date of Patent: Apr. 24, 2001

(54) COMPACT KEY STRUCTURE

(75) Inventor: Gino Hu, Taipei (TW)

(73) Assignee: Silitek Corporation, Taipei (TW)

( * ) Notice: Subject to any disclaimer, the term of this patent is extended or adjusted under 35 U.S.C. 154(b) by 0 days.

(21) Appl. No.: 09/225,713

(22) Filed: Jan. 6, 1999

(51) Int. Cl.[7] ..... G09G 5/00

(52) U.S. Cl. ..... 345/168; 341/20; 341/22; 341/31; 341/32; 341/33; 341/34

(58) Field of Search ..... 345/168; 341/20, 341/22, 31, 32, 33, 34

(56) References Cited

U.S. PATENT DOCUMENTS

| | | | | |
|---|---|---|---|---|
| 5,872,560 | * | 2/1999 | Droege | 345/168 |
| 5,917,437 | * | 6/1999 | Ojala et al. | 341/34 |
| 5,933,133 | * | 10/1999 | Lohr | 345/168 |
| 5,969,644 | * | 10/1999 | Koutaka | 345/168 |
| 6,078,274 | * | 6/2000 | Inou | 345/173 |
| 6,093,477 | * | 7/2000 | Matsufusa et al. | 345/173 |

* cited by examiner

*Primary Examiner*—Richard Hjerpe
*Assistant Examiner*—Ali A. Zamani
(74) *Attorney, Agent, or Firm*—Rosenburg, Klein & Lee

(57) ABSTRACT

A key structure comprises base plate, elastic member, frame and cap wherein the conductive membrane thereof is single-film structure, the contact of the conductive membrane corresponding to each key is of meshed-hook shape (ᘓ), a venting aperture is provided at the center of the contact. A transparent and insulating layer is arranged upon the conductive membrane to prevent the short circuit of the circuit in the conductive membrane. An opening is provided at the transparent and insulating layer and corresponding to the conductive membrane. Both ends of the elastic member are attached to the cap and the transparent and insulating layer by adhesive. A conductive bump with a conductive layer is provided on the elastic member such that the conductive bump of the elastic member is connected to the contact of the conductive membrane and a closed loop is formed within the key when the cap is pressed down, whereby the signal generated by key stroking action is transmitted to the computer. The conductive membrane is designed to be single-film structure, whereby the keyboard is more compact with reduced height.

4 Claims, 4 Drawing Sheets

COMPACT KEY STRUCTURE

FIELD OF THE INVENTION

The present invention relates to a compact keyboard, more particularly, to a compact keyboard the conductive membrane thereof, is designed to be single-film structure, whereby the keyboard is more compact with reduced height.

BACKGROUND OF INVENTION

The conventional conductive membrane of computer key is generally composed of two or three stacking conductive films such that the height of the key is hard to scale down. Moreover, the conductive membrane may have the problem of poor contact if one of those stacking films is obliquely placed.

Therefore, it is an object of the present invention to provide a compact key structure, which also has reduced cost.

In one aspect of the invention, the present invention provides a key structure comprising base plate, elastic member, frame and cap wherein the conductive membrane thereof is single-film structure, the contact of the conductive membrane corresponding to each key is of meshed-hook shape (ᘐ), a venting aperture is provided at the center of the contact. A transparent and insulating layer is arranged upon the conductive membrane to prevent the short circuit of the circuit in the conductive membrane. An opening is provided at the transparent and insulating layer and corresponding to the conductive membrane. Both ends of the elastic member are attached to the cap and the transparent and insulating layer by adhesive. A conductive bump with a conductive layer is provided on the elastic member such that the conductive bump of the elastic member is connected to the contact of the conductive membrane and a closed loop is formed within the key when the cap is pressed down, whereby the signal generated by key stroking action is transmitted to the computer. The conductive membrane is designed to be single-film structure, whereby the keyboard is more compact with reduced height.

In another aspect of the present invention, the elastic member is attached with the cap by a non-reactive adhesive, which can be repeatedly used.

In still another aspect of the present invention, the surface of the elastic member attached to the cap is of staircase shape and has venting holes formed on the lateral side such that the air within the elastic member flows out from a venting aperture when the elastic member is pressed down, and the air flows in from at least one venting holes when the elastic member is released.

The various objects and advantages of the present invention will be more readily understood from the following detailed description when read in conjunction with the appended drawing, in which:

DETAIL DESCRIPTION OF PREFERRED EMBODIMENT

Figure 1:
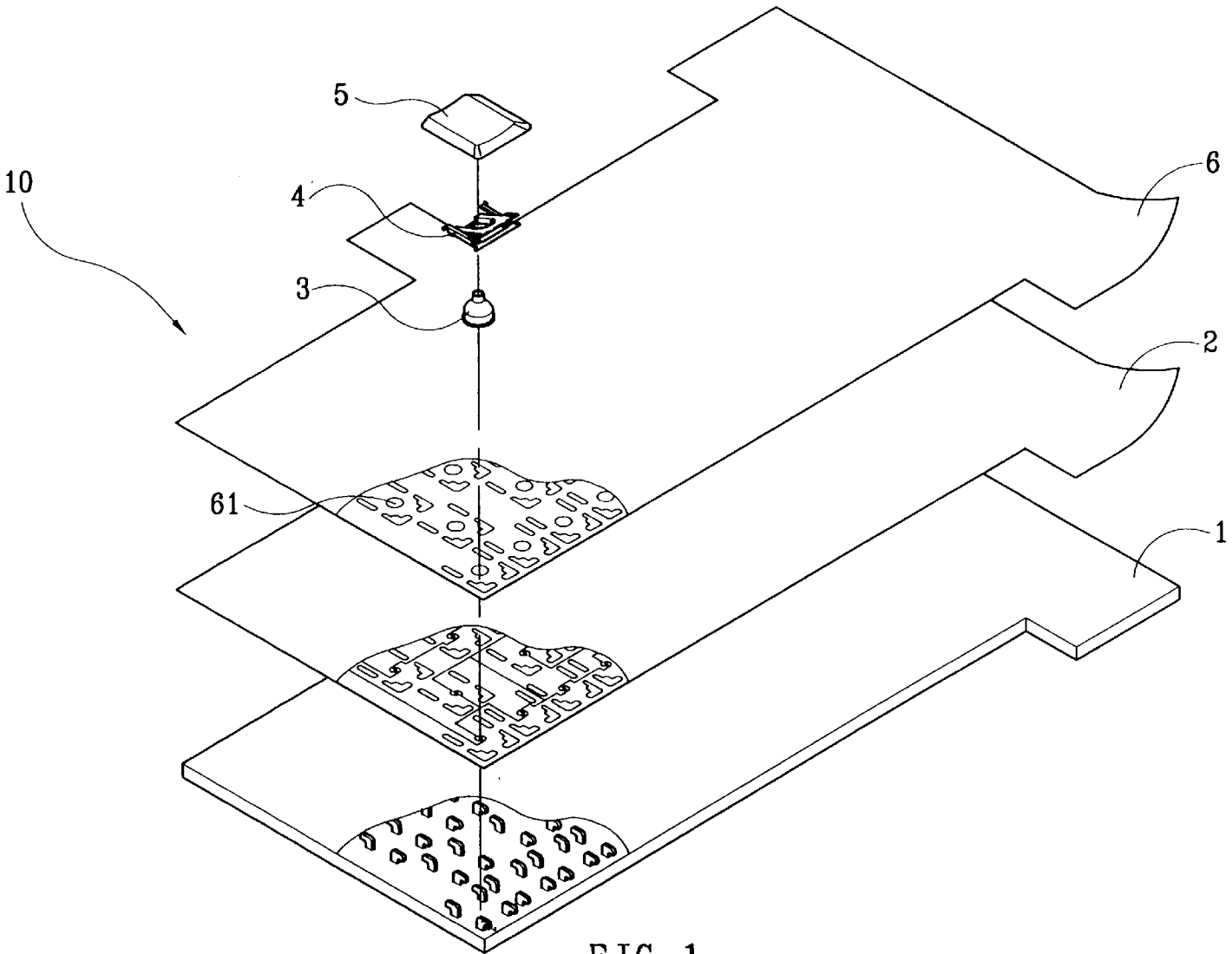
FIG. 1 is the exploded view of the invention key structure.
Figure 2:
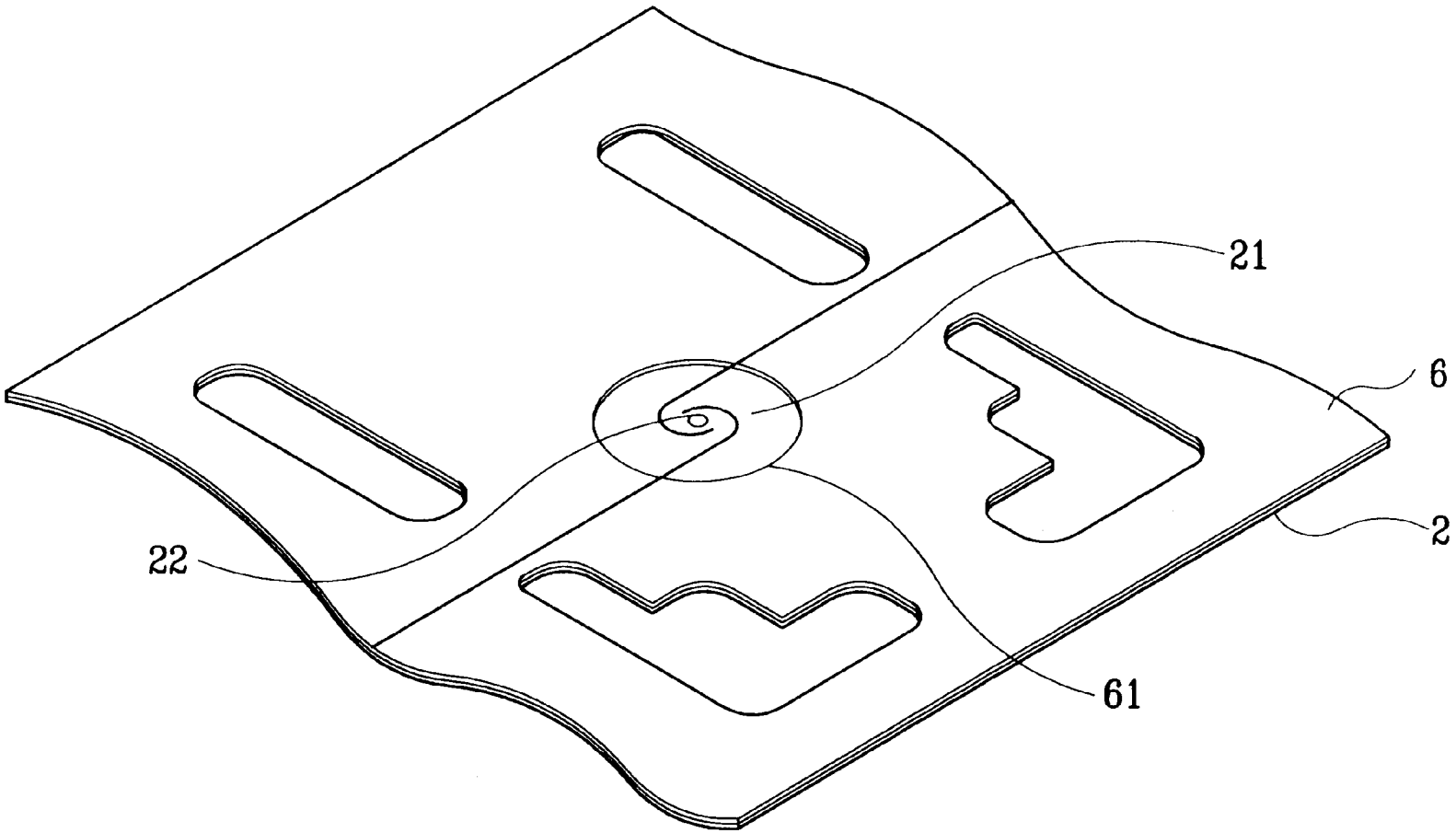
FIG. 2 is the schematic view of the conductive membrane in the invention.

As shown in FIG. 1, the inventive key 10 comprises a base plate 1, a conductive membrane 2, an elastic member, a frame 4 and a cap 5 and the descriptions about the base plate 1, the frame 4 and a cap 5 are omitted because they are well-known art. With reference now to FIG. 2, the conductive membrane 2 is single-film structure and has contact 21 formed at the location corresponding to the key 10. The contact 21 is of mesh-hooks shape (ᘐ) and a venting aperture 22 is formed at the center of the contact 21. Moreover, an insulating and transparent film 6 is provided on the conductive membrane 2, which has an opening 61 corresponding to the contact 21.

Figure 3:
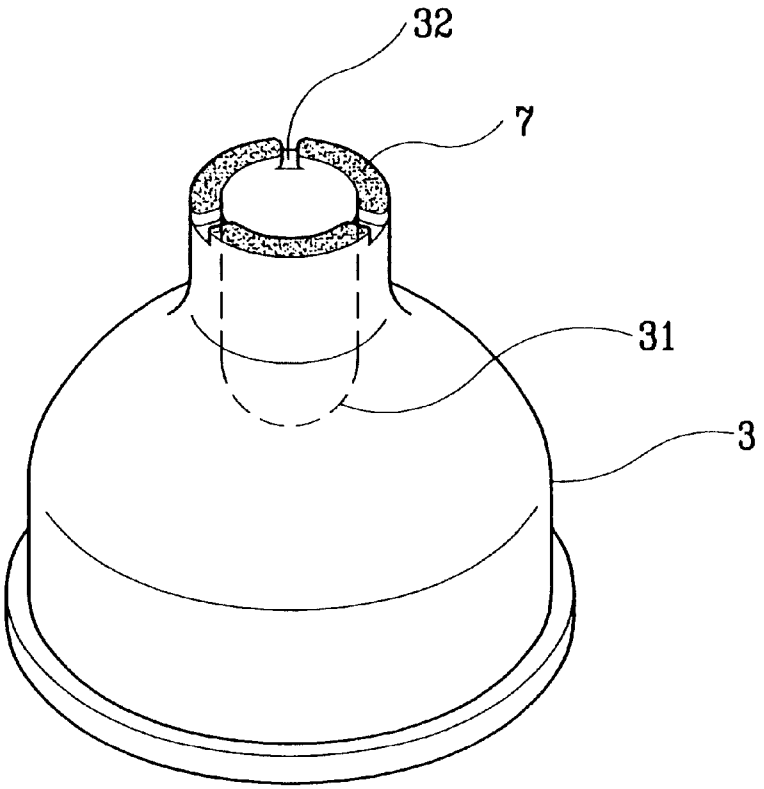
FIG. 3 is the perspective view of the elastic member in the invention.

As shown in FIG. 3, the elastic member 3 is of dome-shape and is provided with a conductive bump 31. The conductive bump 31 has a conductive layer 311 at location corresponding to the contact 21 of the conductive membrane 2. Both sides of the conductive membrane are attached to the cap 5 and the top of the opening 61, respectively. The bump 31 of the elastic member 3 is placed at location corresponding to the contact 21 of the conductive membrane 2. The elastic member 3 is attached with the cap 5 by a non-reactive adhesive 7, which can be repeatedly used. Therefore, the cap 5 can be repeatedly assembled onto and separated from the elastic member. The attached surface of the elastic member 3 with the cap 5 is staircase shape and has at least one venting hole 32 formed on the lateral side.

Figure 4:
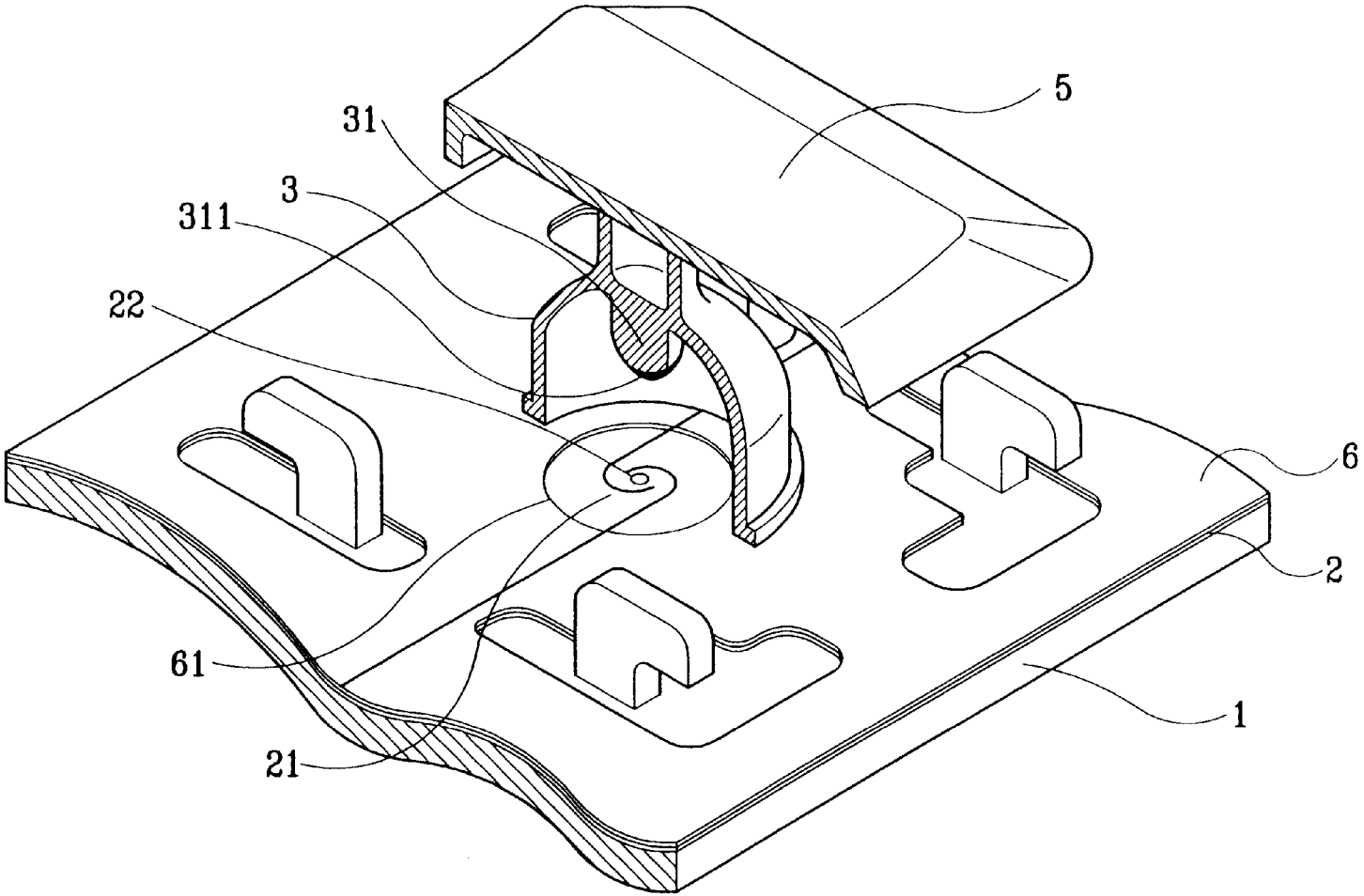
FIG. 4 is a view showing the assembling of the invention.

With reference now to FIGS. 1 and 4, when assembling the base palte 1, the conductive membrane 2, the transparent and insulating film 6, the elastic member 3, the frame 4 and the cap 5 together, the larger and of the elastic member 3 is arranged upon the opening 61 of the transparent and insulating film 6, and the conductive bump 31 of the elastic member 3 is placed corresponding to the meshed-hook shape (ᘐ) contact 21. Moreover, the cap 5 is attached to the smaller end of the dome-shape elastic member 3 by adhesive 7. In this way, the conductive bump 31 of the elastic member 2 is, through the opening 61, connected to the contact 21 and a closed loop is formed within the key when the cap 5 is pressed down, whereby the signal generated by key stroking action is transmitted to the computer.

In the invention, at least one venting hole 32 is formed on the end of the elastic member 3 attached to the cap 5 such that air within the elastic member 3 flows out from the aperture 22 of the conductive membrane 2 when the cap 5 is pressed down, and air flows in from the venting holes 32 to restore the shape of the elastic member 3 when the pressing force is removed. Moreover, the provision of the transparent and insulating film 6 upon the conductive membrane 2 can prevent the short circuit problem of the circuit on the conductive membrane 2.

To sum up, by the structure of the inventive key, the height of the key can be reduced and the lost thereof is also reduced.

Although the present invention has been described with reference to the preferred embodiment thereof, it will be understood that the invention is not limited to the details thereof Various substitutions and modifications have suggested in the foregoing description, and other will occur to those of ordinary skill in the art. Therefore, all such substitutions and modifications are intended to be embraced within the scope of the invention as defined in the appended claims.

I claim:

1. A key structure comprising:

a base plate;

a conductive membrane overlaying said base plate, said conductive membrane being a single-film structure and having a plurality of contact areas defined thereon, each said contact area being defined by a pair of J-shaped conductors adjacently located in spaced relationship each to the other;

a transparent and insulating film being disposed upon said conductive membrane and having a plurality of openings formed therethrough respectively located at positions corresponding to said contact areas;

a plurality of elastic members positioned on said transparent and insulating film in respective correspondence with said openings, each of said elastic members having a conductive bump aligned with a respective contact area of said conductive membrane;

a plurality of caps respectively attached to said plurality of elastic members, each of said caps being secured to an upper end of a corresponding elastic member; and, a plurality of frames respectively coupling said plurality of caps to said base plate.

2. The key structure as recited in claim 1, wherein each said cap is secured to said upper end of a corresponding elastic member by a non-reactive adhesive to allow repeated disassembly and reassembly of said cap.

3. A key structure comprising:

a base plate;

a conductive membrane overlaying said base plate, said conductive membrane being a single-film structure and having a plurality of contact areas defined thereon, each said contact area being defined by a pair of J-shaped conductors adjacently located in spaced relationship each to the other and a centrally disposed venting aperture formed therethrough;

a transparent and insulating film being disposed upon said conductive membrane and having a plurality of openings formed therethrough respectively located at positions corresponding to said contact areas;

a plurality of elastic members positioned on said transparent and insulating film in respective correspondence with said openings, each of said elastic members having a conductive bump aligned with a respective contact area of said conductive membrane;

a plurality of caps respectively attached to said plurality of elastic members, each of said caps being secured to an upper end of a corresponding elastic member; and, a plurality of frames respectively coupling said plurality of caps to said base plate.

4. A key structure comprising:

a base plate;

a conductive membrane overlaying said base plate, said conductive membrane being a single-film structure and having a plurality of contact areas defined thereon, each said contact area being defined by a pair of J-shaped conductors adjacently located in spaced relationship each to the other;

a transparent and insulating film being disposed upon said conductive membrane and having a plurality of openings formed therethrough respectively located at positions corresponding to said contact areas;

a plurality of elastic members positioned on said transparent and insulating film in respective correspondence with said openings, each of said elastic members having a conductive bump aligned with a respective contact area of said conductive membrane;

a plurality of caps respectively attached to said plurality of elastic members, each of said caps being secured to an upper end of a corresponding elastic member, said upper end of each said elastic member having a staircase shape with at least one venting hole formed through a lateral side thereof; and, a plurality of frames respectively coupling said plurality of caps to said base plate.

* * * * *